US006240662B1

(12) United States Patent
Borowiak

(10) Patent No.: US 6,240,662 B1
(45) Date of Patent: Jun. 5, 2001

(54) SNOW PLOW HAVING REMOVABLE PLOW GUARD ATTACHMENT

(76) Inventor: Jeff Borowiak, 4932 M-32 East, Gaylord, MI (US) 49735

( * ) Notice: Subject to any disclaimer, the term of this patent is extended or adjusted under 35 U.S.C. 154(b) by 0 days.

(21) Appl. No.: 09/079,771

(22) Filed: May 15, 1998

Related U.S. Application Data

(60) Provisional application No. 60/046,959, filed on May 19, 1997.

(51) Int. Cl.[7] ..... E02F 3/96
(52) U.S. Cl. ..... 37/404; 37/270
(58) Field of Search ..... 37/233, 264, 270, 37/232, 266, 449, 404; 172/811

(56) References Cited

U.S. PATENT DOCUMENTS

| | | | | |
|---|---|---|---|---|
| Re. 31,045 | | 10/1982 | Essel et al. | 37/281 |
| 2,061,585 | * | 11/1936 | Meyer | 37/233 |
| 2,245,545 | * | 6/1941 | Miller et al. | 37/266 |
| 2,276,265 | * | 3/1942 | Sturtz | 37/270 |
| 2,498,470 | * | 2/1950 | Wenner | 37/266 |
| 2,722,064 | * | 11/1955 | Jaffe et al. | 37/232 |
| 2,936,537 | * | 5/1960 | Bain | 37/233 |
| 3,466,766 | | 9/1969 | Kahlbacher | 37/41 |
| 3,762,077 | | 10/1973 | Henry et al. | 37/41 |
| 3,808,714 | | 5/1974 | Reissinger et al. | 37/42 VL |
| 3,831,389 | * | 8/1974 | Smith | 172/276 |
| 4,073,077 | | 2/1978 | Essel et al. | 37/50 |
| 4,279,084 | | 7/1981 | Low et al. | 37/42 R |
| 4,521,980 | * | 6/1985 | Solaja | 37/117.5 |
| 4,570,366 | | 2/1986 | Yost | 37/232 |
| 4,794,710 | | 1/1989 | Häring | 37/232 |
| 5,077,919 | * | 1/1992 | Sinykin | 37/232 |
| 5,775,012 | * | 7/1998 | Hockensmith | 37/232 |

* cited by examiner

*Primary Examiner*—Robert E. Pezzuto
*Assistant Examiner*—Kristine M. Markovich
(74) *Attorney, Agent, or Firm*—Bliss McGlynn, P.C.

(57) ABSTRACT

A guard attachment for removably mounting to a plow blade having a blade edge. The guard attachment includes a guard member having an arcuate surface which is adapted to shield the blade of the plow such that the guard member may be brought into sliding engagement with the surface to be plowed without catching or snagging obstructions on the surface. Furthermore, the guard member includes a fastening mechanism which removably mounts the guard member to the plow.

2 Claims, 4 Drawing Sheets

FIG-2
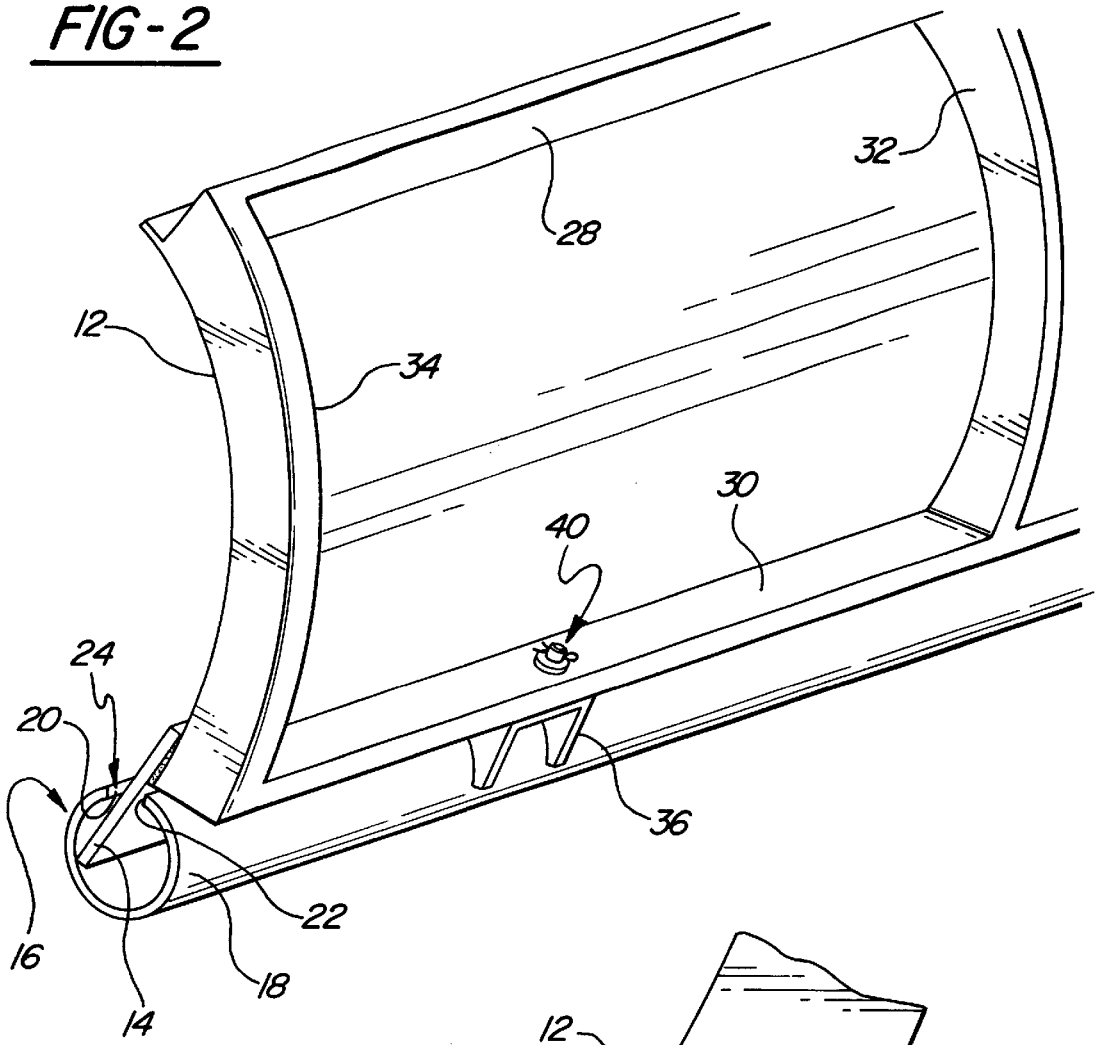
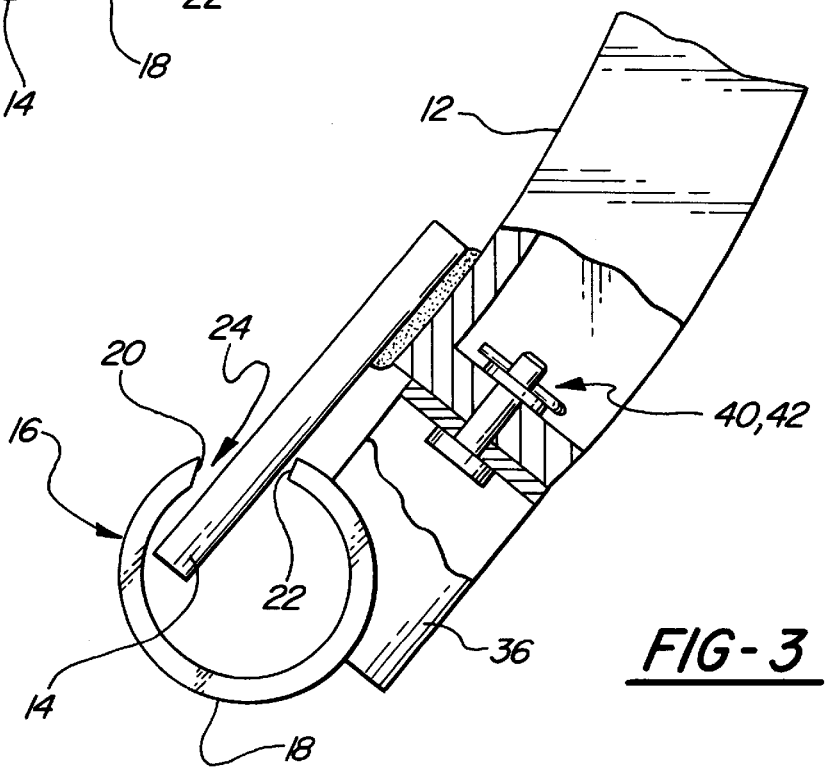
FIG-3

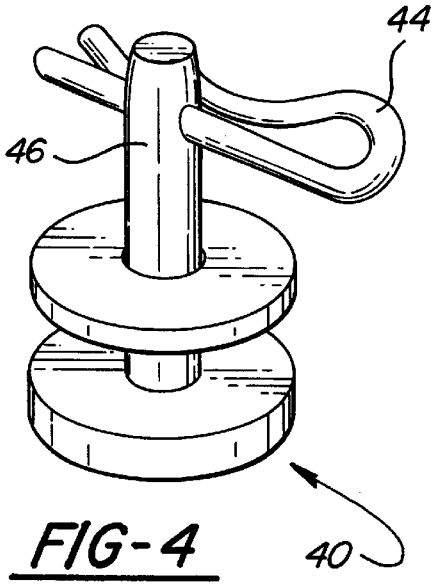
FIG-4
FIG-5
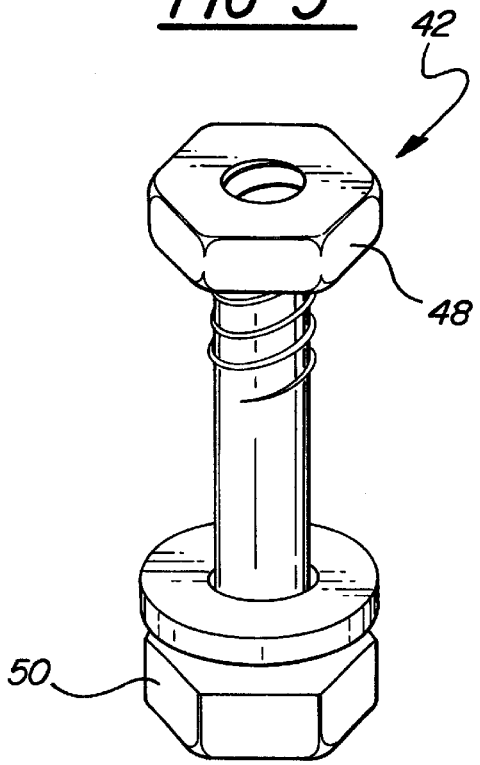
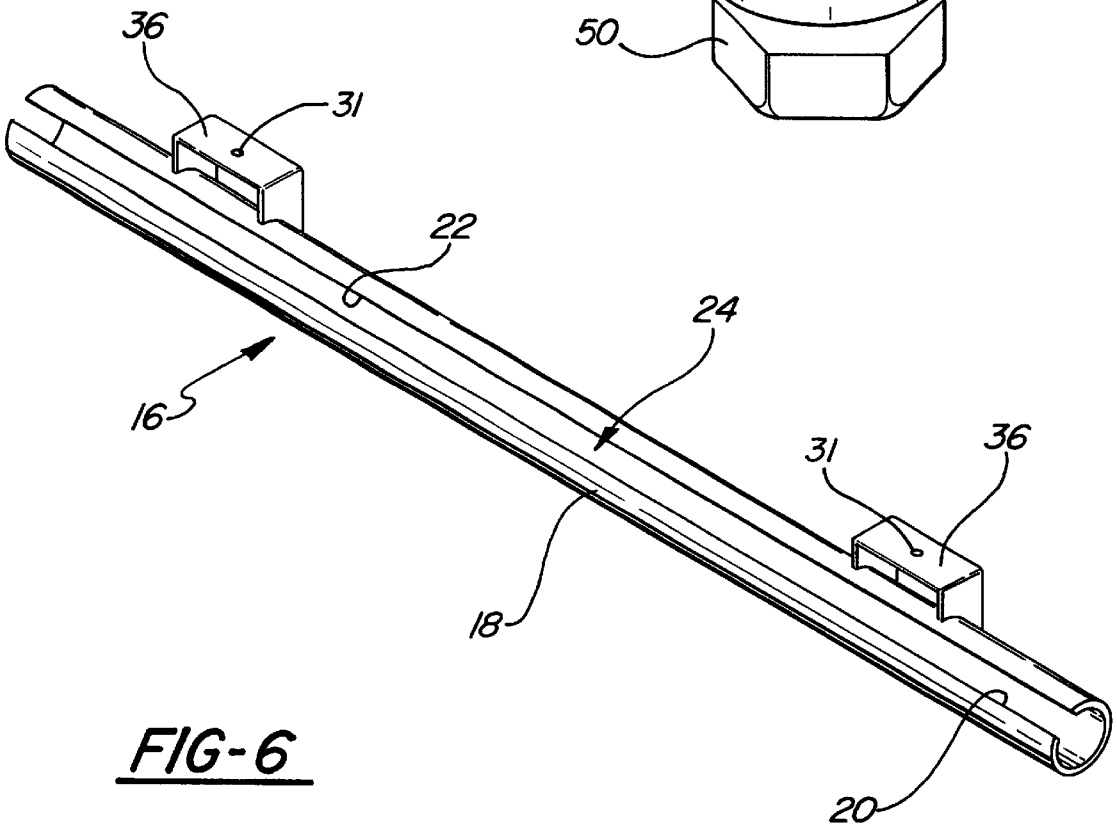
FIG-6

SNOW PLOW HAVING REMOVABLE PLOW GUARD ATTACHMENT

This application claims priority to and all benefits from the provisional application having U.S. Ser. No. 60/046,959 filed May 19, 1997 and entitled Snow Plow Having Removable Plow Guard Attachment

BACKGROUND OF THE INVENTION

1. Field of the Invention

The present invention relates, generally, to snow plows and, more specifically, to a snow plow having a removable guard attachment which prevents damage to soft, plowable surfaces such as gravel surfaces or grass and which protects against plow slap.

2. Description of the Related Art

Snow plows are well known in the art and generally include a plow blade mounted to a vehicle. The plow blade usually includes a blade edge which is brought into contact with the surface to be plowed. Snow plows commonly known in the art often employ shoes mounted to the plow blade and have feet which are adapted to ride in sliding contact with the surface to be plowed. The position of the feet relative to the plow blade may be adjusted to adjust the height of the plow blade relative to the surface to be plowed. In this way, the degree to which the blade edge scrapes the surface to be plowed may be controlled.

During the early part of the snow plow season, before the ground has sufficiently frozen and in the latter part of the season (which includes spring in some latitudes) where the ground has thawed sufficiently, the plow blade as well as shoes can get caught on the surface being plowed or can cause damage to adjacent areas. More specifically, on soft turf or non-frozen surfaces, the shoes can dig into such surfaces, causing ruts or causing the roadway or adjacent turf to be ripped up. Additionally, when the plow blade encounters a fixed obstruction in the surface to be plowed, this may cause the plow to rotate about a generally horizontal axis and can result in a phenomenon known as "plow slap" in the related art. Plow slap is highly detrimental to the life of the plow assembly and can even cause damage to the vehicle on which the plow is mounted.

Attempts have been made in the related art to overcome the disadvantages described above. For example, U.S. Pat. No. 4,798,710, issued to Haring on Jan. 3, 1989; U.S. Pat. No. 4,570,366, issued to Yost on Feb. 18, 1986 and U.S. Pat. No. 3,808,714, issued to Reissinger et al. on May 7, 1974 all disclose snow plow assemblies which include blade edges which rotate or are otherwise yieldable to obstructions presented in the surface to be plowed. However, each of the snow plow assemblies described in these patents involve relatively complex structures and multiple moving parts, all of which add cost to the assemblies.

Still other efforts have been made in the related art to overcome the difficulties discussed above. For example, it is known to weld or otherwise permanently affix a pipe to the blade edge of the plow as a means of avoiding damage to the surface to be plowed. However, this solution suffers from the disadvantage that once the ground has frozen, such measures are not needed and may even become counterproductive. Other attempts to removably mount the pipe to the blade via chains and other mechanisms have been cumbersome and less than satisfactory.

Thus, there is a need in the art for a snow plow which has a removable attachment which prevents damage to the surface to be plowed when it is soft and susceptible to such damage, which prevents plow slap and which may be removed when it is not needed such as when the surface has become frozen.

SUMMARY OF THE INVENTION

The present invention overcomes the disadvantages in the related art in a snow plow assembly having a removable plow guard attachment. More specifically, the guard attachment includes a guard member having an arcuate or otherwise blunt surface which is adapted to shield the blade edge of the plow. The guard attachment includes a fastening mechanism which removably mounts the guard member to the plow blade.

The arcuate or blunt surface of the guard member slides over the surface to be plowed without catching or snagging on obstructions on the surface. Furthermore, because the guard member does not dig into the surface to be plowed, there is no need for the use of shoes with the plow assembly of the present invention. In this way, the plow slap which is common with plow assemblies of the related art, is avoided.

Thus, the deficiencies in the related art are overcome in an efficient, cost-effective snow plow assembly having a removable guard attachment which prevents plow slap and damage to the plowed surface.

BRIEF DESCRIPTION OF THE DRAWINGS

Other advantages of the invention will be readily appreciated as the same becomes better understood by reference to the following detailed description when considered in connection with the accompanying drawings, wherein:

FIG. 2 is a perspective view from the rear of the snow plow assembly of the present invention;

FIG. 3 is a cross-sectional end view of the snow plow assembly having a removable guard attachment of the present invention;

FIG. 4 is a perspective view of one embodiment of a fastener which may be employed with the snow plow assembly of the present invention;

FIG. 5 is a perspective view of another embodiment of a fastener which may be employed with the snow plow assembly of the present invention;

FIG. 6 is a perspective view of the guard member of the present invention;

DETAILED DESCRIPTION OF THE PREFERRED EMBODIMENT(S)

Figure 1:
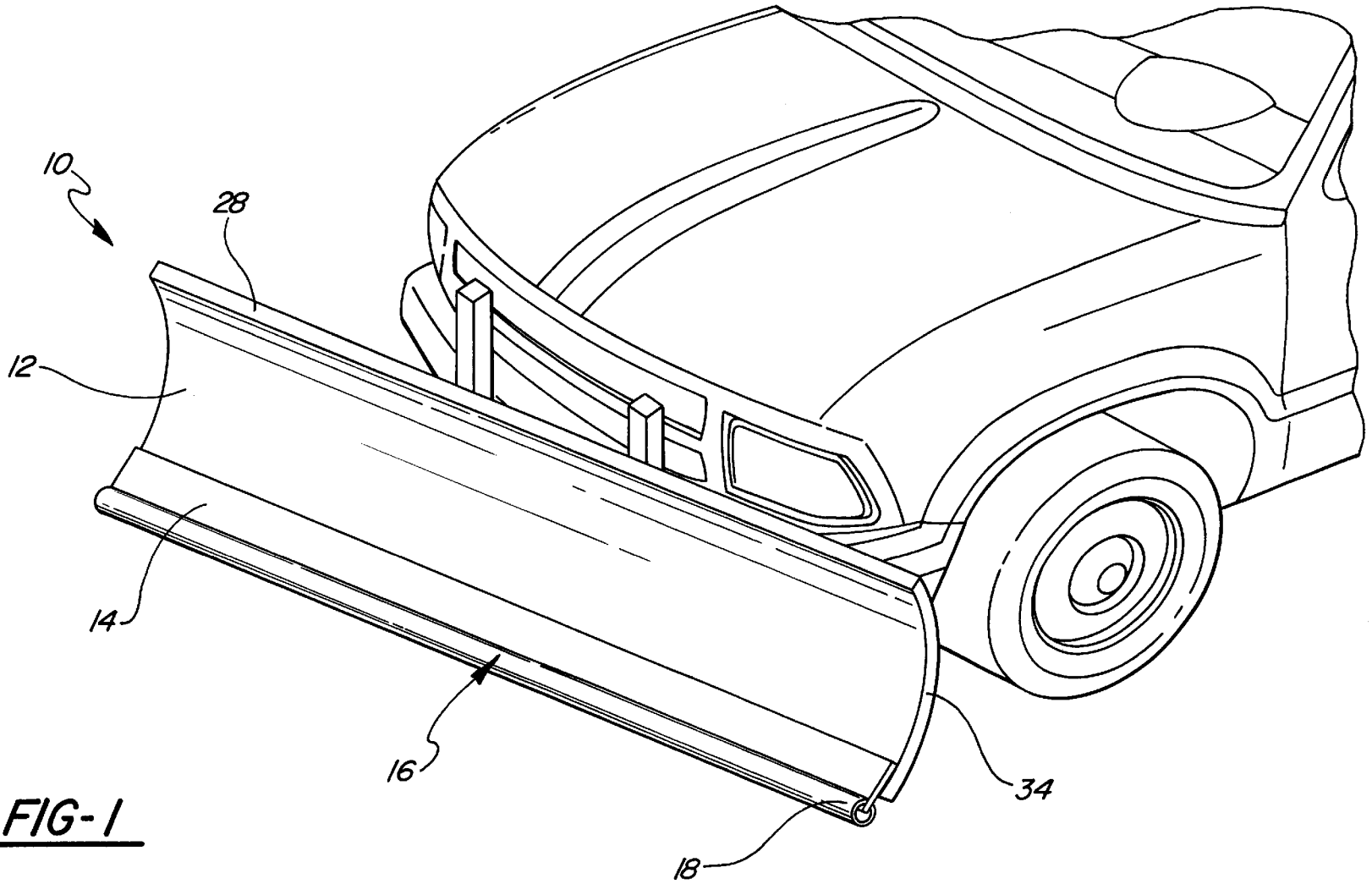
FIG. 1 is a perspective view from the front of a vehicle having a snow plow assembly of the present invention.
Figure 7:
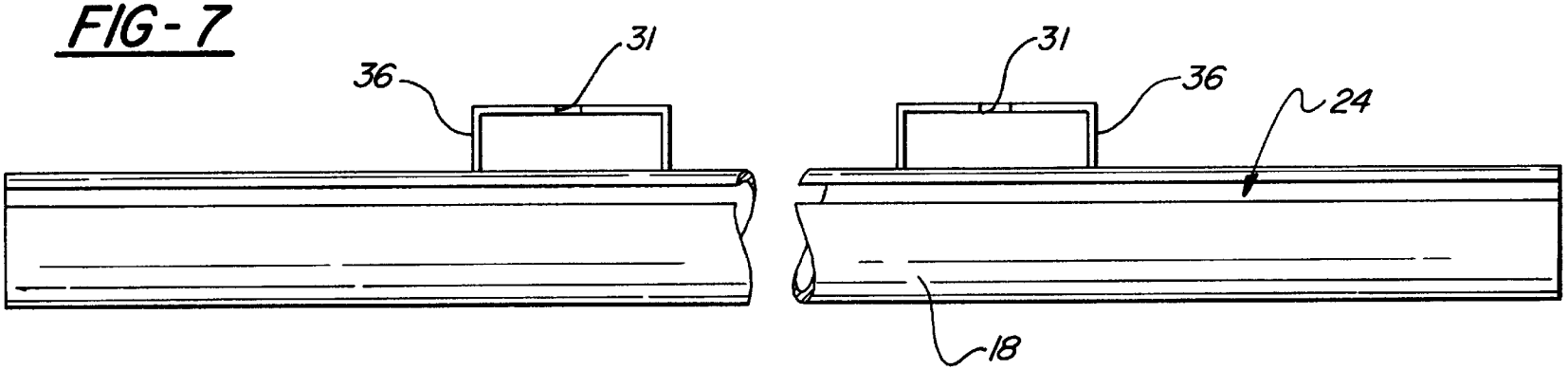
FIG. 7 is a side view of the guard member of the present invention.
Figure 8:
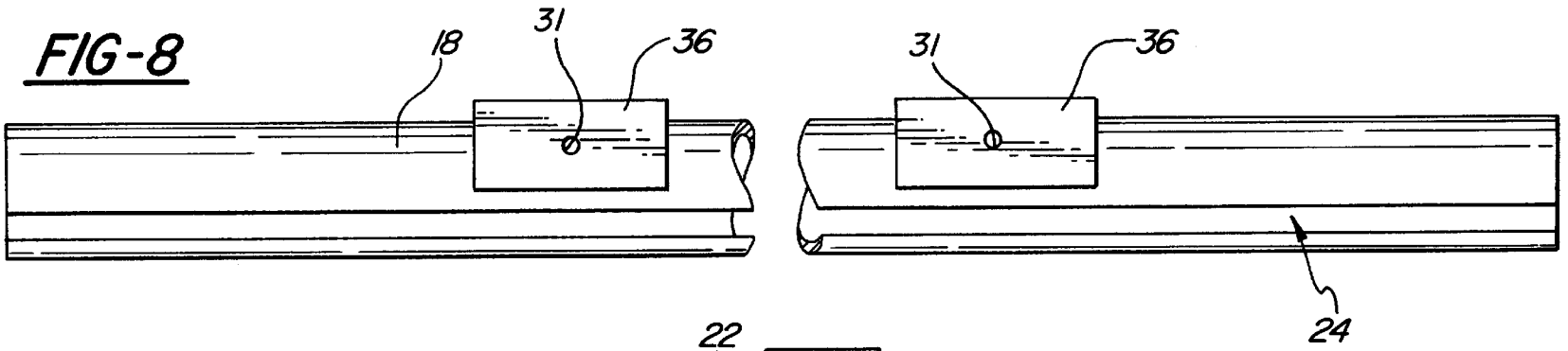
FIG. 8 is a top view of the guard member of the present invention.
Figure 9:
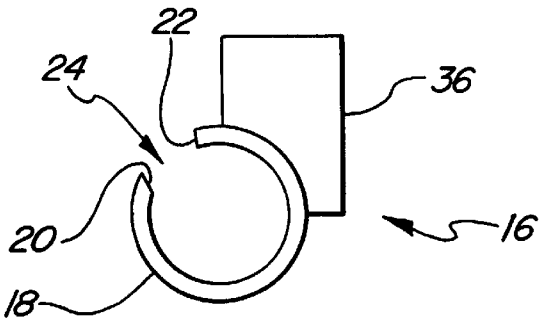
FIG. 9 is a cross-sectional end view of the guard member of the present invention.

Referring now to the drawing, a snow plow assembly is generally indicated at 10 in FIG. 1 and shown mounted to a vehicle such as a truck. The assembly 10 includes a conventional plow blade 12 having an arcuate working surface and a blade edge 14 extending from the lower portion of the plow blade 12. The blade edge 14 is traditionally adapted to engage the surface to be plowed. However, the assembly of the present invention also includes a removable plow guard attachment generally indicated at 16. The plow guard attachment 16 includes a guard member 18 which extends along the length of the blade edge 14 and is thereby adapted to shield the blade edge 14 of the plow blade 12.

The guard member 18 is made of metal or some other suitably durable material which is rolled to form a substantially closed tube but with the free ends 20, 22 of the tube spaced relative to one another to form a longitudinally extending slot 24 as shown in FIGS. 2 and 3. Alternatively, the guard member 18 may be manufactured from a pipe with the slot 24 cut into the pipe. In this regard, the inventor has found that schedule 40 gauge pipe having a thickness of ¼ inch is most suitable for such purposes. In either embodiment, the guard member 18 has an elongated, hollow, tubular shape defining an arcuate outer wall with the slot 24 formed at the outer wall of the guard member 24. The blade edge 14 is received through the slot 24 when the guard member 18 is mounted to the plow blade 18 as described in greater detail below.

As best shown in FIG. 2, the plow blade 12 typically includes upper and lower flanges 28, 30, respectively, extending along the longitudinal length at the rear of the plow blade 12 in spaced relation relative to one another. Often, intermediate reinforcing flanges 32 extend between the upper and lower flanges 28, 30 at predetermined intervals along the longitudinal length of the plow blade. Likewise, end flanges 34 are located near the side edges of the rear of the plow blade 12 and extend between the upper and lower flanges 28, 30. The plow blade 12 is articulated between raised and lowered positions and may be otherwise oriented relative to the surface to be plowed through hydraulically or mechanically activated linkages mounted to the vehicle. These elements are well known in the art and form no part of the invention.

The guard member 18 has a fastening mechanism including a plurality of mounting flanges 36 strategically disposed spaced along the longitudinal length of the guard member for mounting the guard member 18 to the plow blade 12. More specifically, the mounting flanges 36 are fixed to the outer wall of the guard member 18 and are adapted to cooperate with the lower flange 30 of the plow blade 12. To this end, both the mounting flanges 36 and the lower flange 30 include apertures 31 which are coordinated to be aligned with respect to each other. A fastener, such as the codder pin 44 operatively received through the hole in the flanged shaft 46 generally indicated at 40 in FIG. 4 or the nut 48 and bolt 50 arrangement generally indicated at 42 in FIG. 5, may be employed to releasably secure the guard member 18 to the plow blade 12. Additionally, it will be apparent to those of ordinary skill in the art that a number of different fasteners may be employed at this juncture to facilitate removably mounting of the guard member 18 to the plow 12. For example, it is conceivable that the guard member 18 may be mounted to structure on the plow blade 12 other than the lower flange 30 and may even be mounted to some other mechanism or device which is ultimately supported by the plow 12.

The guard member 18 presents an arcuate or otherwise blunt working surface which engages the surface to be plowed. The guard member 18 may be a single, unitary piece or it may be formed by a plurality of tubular members and mounted so as to present an arcuate, blunt surface along at least a portion of the blade edge 14. In its operative mode, the arcuate or blunt surface of the guard member 18 slides over the surface to be plowed without catching or snagging obstructions on the surface. Furthermore, because the guard member 18 does not dig into the surface to be plowed, there is no need for the use of shoes with the plow assembly of the present invention. In this way, plow slap, which is common with plow assemblies of the related art, is avoided. Once the surface to be plowed has become frozen or, to the extent that any given surface is sufficiently hard such that the plow guard attachment 16 of the present invention is not required, it may be quickly and easily removed from the plow blade 12 by actuating the codder and pin arrangement 40 or the nut and bolt arrangement 42 as illustrated in FIGS. 3 through 5. In this way, the plow guard attachment 16 of the present invention is not permanently mounted to the plow blade 12 but rather may be quickly and efficiently employed when needed and set aside when conditions do not warrant its use.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

I claim:

1. A snow plow blade guard attachment for removably mounting to a plow blade having a blade edge, said guard attachment comprising:

a guard member having an elongated, hollow, tubular shape defining an outer wall having an arcuate surface which is adapted to shield the blade edge of the plow, and a slot formed in said outer wall of said tubular guard member which extends substantially along the length of the blade edge, said slot being adapted to receive the blade edge such that said tubular guard member may be brought into sliding engagement with the surface to be plowed without catching or snagging obstructions on the surface;

said guard member including a plurality of fastening mechanisms fixed to said guard member and located at spaced locations along the length of said tubular guard member; and said plurality of fastening mechanisms including mounting flanges, each of said mounting flanges including an aperture which aligns with a corresponding aperture on a lower rear flange of the plow blade to receive a fastener for removably fixing said guard member to the plow.

2. A snow plow assembly having a removable plow guard attachment, said assembly comprising:

a plow blade having a blade edge, a guard member having an elongated hollow, tubular shape defining an outer wall having an arcuate surface which is adapted to shield said blade edge of said plow blade, and a slot formed in said outer wall of said tubular guard member which extends substantially along the length of the blade edge, said slot being adapted to receive the blade edge such that said tubular guard member may be brought into sliding engagement with the surface to be plowed without catching or snagging obstructions on the surface;

said guard member including a plurality of fastening mechanisms fixed to said guard member and located at spaced locations along the length of said tubular guard member, and said plurality of fastening mechanisms include mounting flanges each of said mounting flanges including an aperture which aligns with a corresponding aperture on the plow blade to receive a fastener for removably fixing said guard member to the plow.

* * * * *